US005322465A

United States Patent [19]

McGill

[11] Patent Number: 5,322,465

[45] Date of Patent: Jun. 21, 1994

[54] HAND PUPPET KIT

[75] Inventor: David P. McGill, Round Lake Beach, Ill.

[73] Assignee: Div. of Plastic Specialties & Tech. Inc. Ozite Company, Libertyville, Ill.

[21] Appl. No.: 982,728

[22] Filed: Nov. 27, 1992

[51] Int. Cl.[5] ..... A63H 3/16; A63H 3/14; A63H 3/36

[52] U.S. Cl. ..... 446/100; 446/327; 446/385

[58] Field of Search ..... 446/75, 97, 98, 99, 446/100, 101, 327, 328, 329, 369, 385, 387, 388

[56] References Cited

U.S. PATENT DOCUMENTS

| | | | |
|---|---|---|---|
| D. 163,733 | 6/1951 | Alexander . | |
| D. 163,734 | 6/1951 | Alexander . | |
| D. 170,734 | 10/1953 | Wright . | |
| D. 190,032 | 4/1961 | Seron . | |
| D. 268,222 | 3/1983 | Chen . | |
| 1,535,925 | 4/1925 | Lee | 446/100 |
| 1,641,175 | 9/1927 | Lemieux . | |
| 2,729,023 | 1/1956 | Lerner et al. . | |
| 2,944,368 | 7/1960 | O'Brian et al. | 446/100 X |
| 3,035,689 | 5/1962 | Arnheiter | 446/100 X |
| 4,378,654 | 4/1983 | Wilson | 446/387 |
| 4,404,243 | 9/1983 | Terpay | 156/72 X |
| 4,504,240 | 3/1985 | Thomas . | |
| 4,531,925 | 7/1985 | Moreau | 446/369 |
| 4,653,295 | 3/1987 | Clifford | 239/500 X |
| 4,728,313 | 3/1988 | Thomas | 446/369 |
| 4,808,139 | 2/1989 | Price | 446/75 |
| 4,828,529 | 5/1989 | Steele . | |
| 4,964,832 | 10/1990 | Bickoff . | |
| 4,979,924 | 12/1990 | Manger . | |

FOREIGN PATENT DOCUMENTS

| | | | |
|---|---|---|---|
| 981177 | 5/1951 | France | 446/100 |
| 423200 | 1/1935 | United Kingdom | 446/100 |
| 2175814 | 12/1986 | United Kingdom | 446/327 |

OTHER PUBLICATIONS

Masburn & Baird, Plaid Enterprises Inc., "Meet the Designers", 1981.

*Primary Examiner*—David N. Muir

*Attorney, Agent, or Firm*—Wood, Phillips, VanSanten, Hoffman & Ertel

[57] ABSTRACT

For maximizing creative play, a hand puppet kit includes a sock-like body member formed of a flexible material to have a hand receiving opening at one end thereof. The kit also includes a separate sheet of flexible material together with at least one pattern for creating a piece in a predetermined shape from the separate sheet of flexible material. With these features, the hand puppet kit further includes at least one portion of a hook and loop fastener to be secured to the piece.

12 Claims, 2 Drawing Sheets

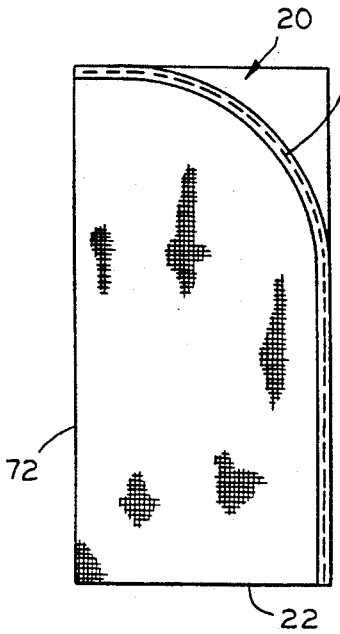
FIG.1
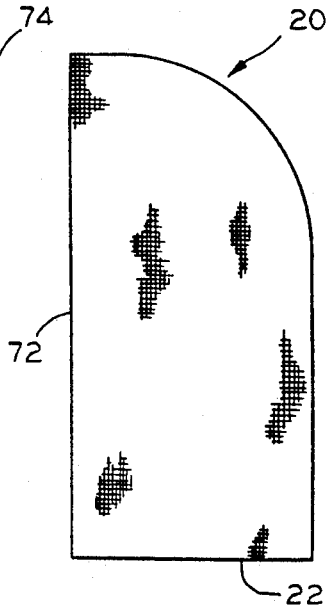
FIG.2
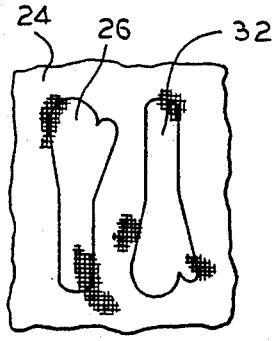
FIG.3
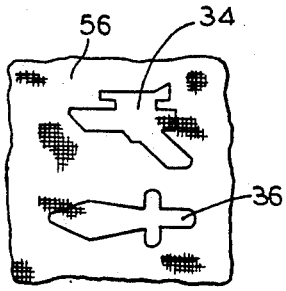
FIG.4
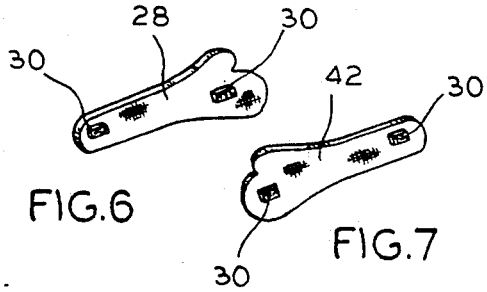
FIG.6
FIG.7
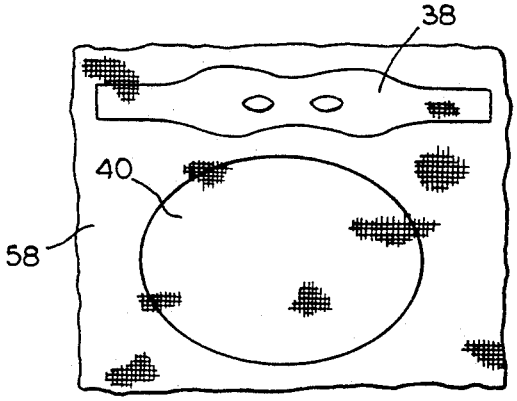
FIG.5
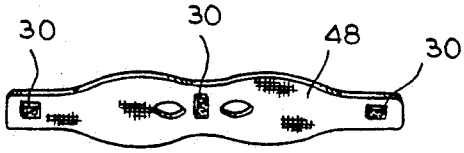
FIG.10
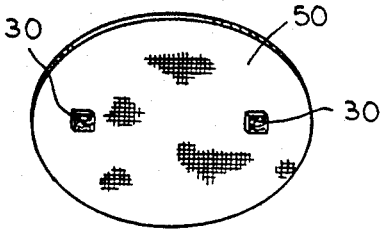
FIG.11
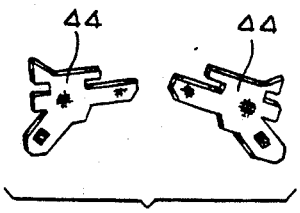
FIG.8
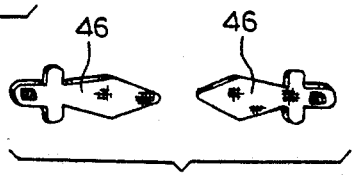
FIG.9

HAND PUPPET KIT

FIELD OF THE INVENTION

The present invention is generally related to hand puppets and, still more particularly, a hand puppet kit for enhancing creative play in children.

BACKGROUND OF THE INVENTION

Hand puppets are well known for encouraging creativity, for instance, by allowing children and adults to engage in roll playing and the like. Unfortunately, many prior art puppets, dolls, and stuffed toys often comprise a fixed character which fails to allow for any change in the various visual, physical and operational characteristics of the puppet. In this connection, these limitations are known to apply to all types of puppets, dolls and stuffed toys including hand puppets.

More recently, there have been suggested various puppets and dolls which allow the user to implement reconfigurations through changes of clothing or the addition of accessories. In fact, it has even been known to permit a change in facial features, but it seems that no hand puppet kit has ever been proposed which truly maximizes creative play opportunities.

Still additionally, hand puppets have conventionally been of limited use as children's toys apart from offering great amusement when animated on the hand. However, they otherwise are of little or no use, for instance, as a decorative item. More specifically, a hand puppet is generally considered as an open, empty and limp structure that is disappointing for other uses such as display or the like.

In view of the foregoing, it has remained to provide a hand puppet kit that truly maximizes creative play. It has also remained to provide such a kit which allows user interaction in the creation of ornamentation to change the character, appearance and/or shape of the puppet at will. Still additionally, it has remained to provide a hand puppet which is also capable of suitable self-supporting display.

The present invention is directed to overcoming one or more of the foregoing problems and achieving one or more of the resulting objects.

SUMMARY OF THE INVENTION

It is therefore an object of the present invention to provide a unique, improved hand puppet kit. It is also an object of the present invention to provide such a kit which truly maximizes creative thought and play through user participation or interaction with the various components of the kit. It is a further object of the present invention to provide a hand puppet kit suited for self-supporting display.

Accordingly, the present invention is directed to a hand puppet kit which includes a sock-like body member formed of a flexible material to have a hand receiving opening at one end thereof. The kit also includes a separate sheet of flexible material together with at least one pattern for creating at least one piece in a predetermined shape from the separate sheet of flexible material. With this understanding, the hand puppet kit further includes means for securing to the body member the piece created from the separate sheet of flexible material using the pattern.

In the exemplary embodiment, the kit will include four separate sheets of different colored flexible material together with at least one pattern for creating all the pieces for a specific puppet kit in a predetermined shape from the separate sheets of flexible material.

With this understanding, the flexible material of the sock-like body member and the separate sheets of flexible material may each be formed of a different colored cloth material. Also, the pattern preferably includes a plurality of patterns in order to be able to create a plurality of different pieces in various predetermined shapes such as head and body features. In this connection, the flexible material of the body member may advantageously be one color with the separate sheets of flexible material being other, contrasting colors or in some cases one of the separate sheets may be the same color.

Still other details include the securing means preferably comprising one portion of a hook and loop fastener to be adhered or permanently secured to any one of the pieces cut for the specific kit by, e.g., a pressure sensitive adhesive applied to the back of the hook and loop fastener portion. It is also advantageous for the separate pieces of flexible material to be larger in size than the pattern in order to be able to create pieces other than those of predetermined shape. Still further details include providing instructions for using the pattern to create the piece and for thereafter using the securing means to secure the piece to the body member.

In a highly preferred embodiment, the hand puppet kit includes a plurality of patterns for creating a plurality of pieces in predetermined shapes. It is also specifically advantageous for the securing means to include a hook fastener portion of a hook and loop fastener to be adhered to the pieces with a pressure sensitive adhesive. In this case, the flexible cloth material of the body member is formed of a cloth having loop fastener portion characteristics.

Preferably, the flexible cloth material of the body member is a first selected color and the kit includes a plurality of sheets of flexible material of other selected contrasting colors. It has also been found advantageous for the flexible cloth material of the body member to be a needle punched polypropylene fiber material texturized to produce a ribbed outer surface thereon and, further, the material preferably has been saturated with a water-base latex and dried in an oven to add stiffness and helps prevent material fuzzing. Additionally, the body member is preferably formed of a generally arch-shaped piece of flexible cloth material doubled over, sewn along the corresponding loose edges thereof, and inverted to conceal the sewn loose edges.

In practice, the body member may be formed by folding over a square or rectangular-shaped piece of fabric, e.g., a 15 inch by 15 inch piece, which is sewn in an arched shape prior to shipment and sale, and the excess material beyond the arch may later be trimmed by the purchaser and used to create additional pieces following which the body portion may be inverted to conceal the sewn loose edges.

Other objects, advantages and features of the present invention will become apparent from a consideration of the following specification taken in conjunction with the accompanying drawings.

BRIEF DESCRIPTION OF THE DRAWINGS

FIG. 1 is a side elevational view of a sock-like body member sewn along loose edges thereof for the hand puppet kit of the present invention;

FIG. 2 is a side elevational view similar to FIG. 1 but with the sock-like body member trimmed close to the sewn area and inverted so as to conceal the sewn loose edges thereof;

FIG. 3 is a top plan view illustrating a sheet of flexible cloth material having a pattern of a pair of body features thereon;

FIG. 4 is a top plan view illustrating a sheet of flexible cloth material having a pattern of a pair of accessory features thereon;

FIG. 5 is a top plan view illustrating a flexible cloth material having a pattern of still additional accessory features thereon;

FIG. 6 is a rear perspective view of one of the body features illustrated in FIG. 3;

FIG. 7 is a rear perspective view illustrating the pair of body features being formed with the pattern as illustrated in FIG. 3;

FIG. 8 is a rear perspective view illustrating one of the accessory features being formed with the pattern as illustrated in FIG. 4;

FIG. 9 is a rear perspective view illustrating the other of the accessory features being formed with the pattern as illustrated in FIG. 4;

FIG. 10 is a rear perspective view illustrating a pair of one of the accessory features being formed with the pattern as illustrated in FIG. 5;

FIG. 11 is a rear perspective view illustrating a pair of the other of the accessory features being formed with the pattern as illustrated in FIG. 5;

DETAILED DESCRIPTION OF THE PREFERRED EMBODIMENTS

Figure 12:
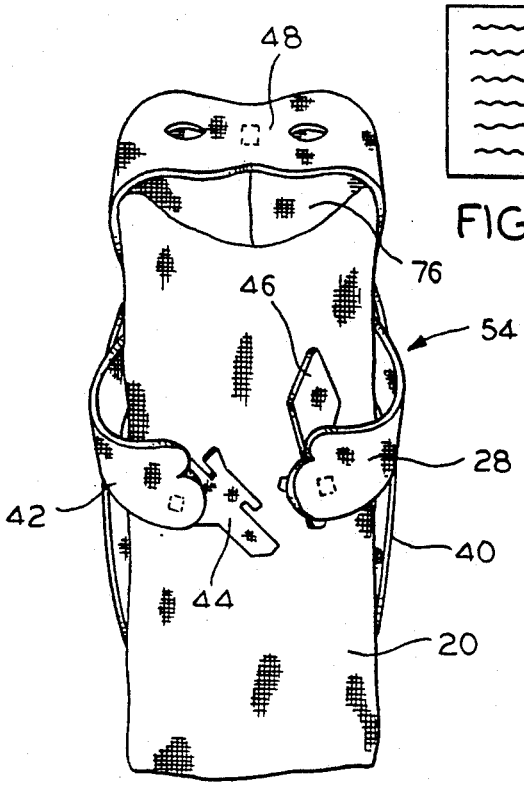
FIG. 12 is a front elevational view of a first hand puppet fully assembled from a hand puppet kit in accordance with the present invention.
Figure 16:
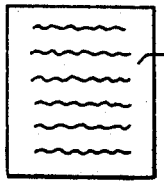
FIG. 16 is a top plan view illustrating instructions for using the patterns and the securing means in accordance with the hand puppet kit of the present invention.

In the illustrations given, and with reference first to FIGS. 1-5 and 16, a hand puppet kit is disclosed which includes a sock-like body member 20 formed of a flexible material to have a hand receiving opening 22 at one end thereof. The kit also includes a separate sheet of flexible material 24 together with at least one pattern 26 for creating a piece 28 in a predetermined shape from the separate sheet of flexible material 24, and means for securing the piece 28 created from the separate sheet of flexible material 24 to the body member 20. In the illustrated embodiment, the securing means may take various forms but advantageously includes at least one portion 30 of a hook and loop fastener to be secured to the piece 28 (see FIG. 6).

Preferably, the flexible material of the sock-like body member 20 and the separate sheet of flexible material 24 are each formed of a cloth material having different or contrasting characteristics such as texture, color, etc. It is also advantageous for the kit to include a plurality of patterns such as 26, 32, 34, 236, 40, etc. so as to be able to create a plurality of pieces such as 28, 42, 44, 46, 48, 50 etc. in predetermined shapes such as head and body features and accessories. With this understanding, the flexible material of the body member 20 is most advantageously one selected color with the separate sheets of flexible material 24 being another selected contrasting color.

While the separate piece of flexible material 24 is shown broken away in FIG. 3, it is preferably larger in size than the pattern or patterns 26 and 32 in order to allow for the creative formation of pieces in addition to the piece or pieces 28 and 42 in the predetermined shape(s). In addition, the kit further preferably includes instructions 52 for using the pattern or patterns 26, 32, 34 etc. and for using the hook and loop fastener portion(s) 30 to secure the piece or pieces 28, 42, 44 etc. to the body member 20 (see FIG. 16).

Figure 13:
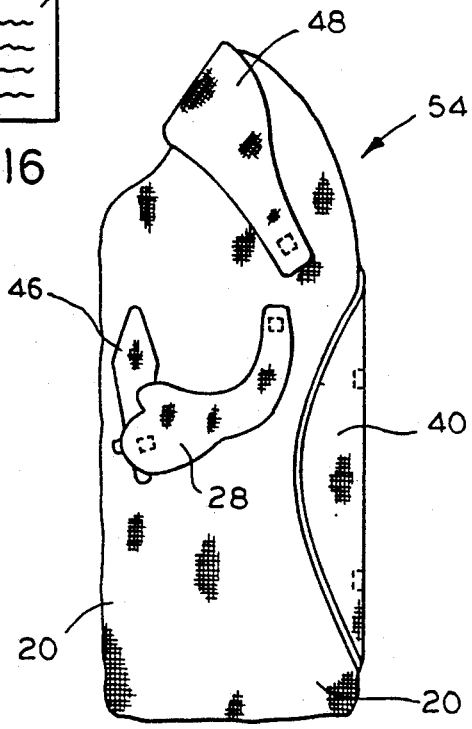
FIG. 13 is a side elevational view illustrating the hand puppet of FIG. 12 after it has been fully assembled from a hand puppet kit.

Advantageously, the securing means comprises a hook fastener portion 30 of a hook and loop fastener such as that sold under the trademark "VELCRO" which can be secured to the pieces such as 28, 42, 44, etc. in which case the flexible cloth material of the body member is formed of a cloth which has the characteristics of a loop fastener portion. More specifically, the flexible cloth material of the body member 20 is advantageously a needle punched polypropylene fiber material which has been texturized to produce a ribbed outer surface thereon and treated by saturation and then removal of the excess of a water-base latex wherein the material has been dried in an oven to add stiffness and prevent material fuzzing. In this manner, the flexible cloth material of the body member 29 not only will be understood to have the desired loop fastener portion characteristics but the resulting material will form a self-supporting hand puppet such as 54 which may be placed on a shelf or night stand after it has been assembled to look substantially as shown in FIGS. 12 and 13.

Figure 14:
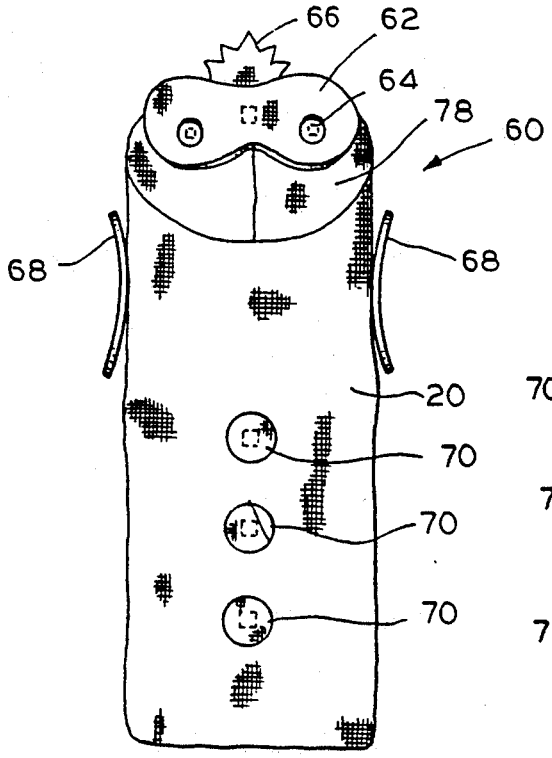
FIG. 14 is a front elevational view of another hand puppet fully assembled from a hand puppet kit in accordance with the hand puppet kit of the present invention.
Figure 15:
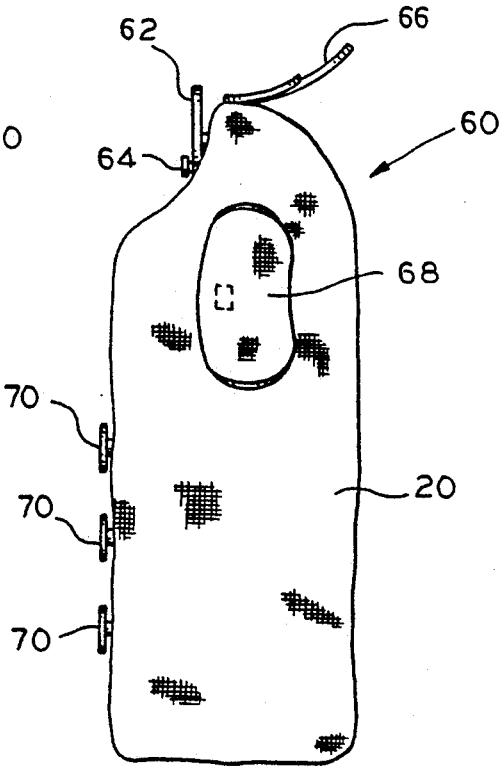
FIG. 15 is a side elevational view illustrating the hand puppet of FIG. 14 after it has been fully assembled from a hand puppet kit.

As previously suggested, the kit is such that the flexible cloth material of the body member 20 is a first selected color with a plurality of sheets of flexible material 24, 56, 58 etc. of other distinct selected contrasting colors being provided (see FIGS. 3-5). This, of course, makes it possible to truly maximize creativity by allowing the user to select the color for the various pattern features provided with the kit and also to use the colors to create other features that are conjured up by the imagination so as to form a hand puppet such as 54 (see FIGS. 3-5, 12 and 13). In fact, the extra material which is provided can be utilized to form an entirely different hand puppet such as 60 having completely distinct head and body features 62, 64, 66, 68, 70 etc. limited only by the imagination (see FIGS. 14 and 15).

Referring once again to FIGS. 1 and 2, the body member 20 is formed of an arch-shaped piece of flexible cloth material doubled over as at 72. It will be seen that this doubled over arch-shaped piece of flexible cloth material is sewn as at 74 along the corresponding loose edges thereof which have been placed in mating relation. As will also be appreciated, the body member 20 is inverted after it has been sewn as at 74 in order to entirely conceal the sewn loose edges (see FIG. 2).

In practice, the body member 20 may be formed by folding over a square or rectangular-shaped piece of fabric, e.g., a 15 inch by 15 inch piece, which is sewn as at 74 in an arched shape prior to shipment and sale, and the excess material beyond the arch may later be trimmed by the purchaser and used to create additional pieces such as 28, 42, 44, 46, 48, 50 etc. following which the body portion 20 may be inverted to conceal the sewn loose edges.

While not specifically shown, it will be appreciated that the loop fastener portion 30 can be provided in the kit in the form of a single sheet of such material. Typically, this sheet of material would have a paper covered pressure sensitive adhesive on a relatively flat surface opposite the loops, and the sheet can thereafter be cut into small squares or other desirable shapes such as illustrated in FIGS. 6–11. When this has been done, the paper can be removed and the loop fastener portion 30 can then be secured to the pieces by means of the pressure sensitive adhesive.

Due to the unique cooperation of the loop fastener portions 30 with the flexible cloth material of the body member 20, the head and body features and accessories illustrated in FIGS. 6–11 may be selectively applied and removed at will in accordance with the imagination of the user. Of course, the sock-like body member 20 can also be formed into various shapes as a soft sculpture to create, by way of example, a mouth as at 76 for the hand puppet 54 or a mouth as at 78 for the hand puppet 60 which further demonstrates how the hand puppet kit of the present invention encourages a maximum creative experience.

As will now be appreciated, the hand puppet kit of the present invention provides a great deal more to the user than a mere hand puppet. It provides something specifically designed to maximize creativity by allowing the user to not only create features and accessories as suggested by the patterns but also to create additional features and accessories limited only by the imagination. Moreover, since the hand puppet is self-supporting, it may be utilized as a decoration in a room by standing it on a shelf or nightstand.

Also, while the flexible cloth material of the body member is stiffened to be self-supporting, it does permit a considerable degree of shaping. This makes it possible to create tucks in the fabric to form noses, mouths, etc. limited only by the imagination. In addition, and in order to further enhance creativity, there would typically be provided on the order of four separate colors for each hand puppet kit.

While a preferred embodiment of the invention has been set forth for purposes of illustration, it will be appreciated that the details herein given may be varied without departing from the true spirit and scope of the appended claims.

I claim:

1. A hand puppet kit, comprising:

a sock-like body member formed of a flexible cloth material to have a hand receiving opening at one end thereof;

a separate sheet of flexible cloth material together with a plurality of patterns for creating a plurality of pieces in predetermined shapes, said predetermined shapes of said pieces including at least some head and body features, said separate sheet of flexible cloth material being larger in size than said patterns for creating pieces other than those in said predetermined shapes; and means for securing said pieces created from said separate sheet of flexible cloth material to said body member;

said flexible cloth material of said body member being a needle punched material treated with latex means heat dried adding stiffness and preventing material fuzzing thereof.

2. The hand puppet kit of claim 1 wherein said flexible cloth material of said sock-like body member and said separate sheet of flexible cloth material are each formed of a different cloth material.

3. The hand puppet kit of claim 1 wherein said securing means includes at least one portion of a hook and loop fastener to be secured to said pieces with a pressure sensitive adhesive.

4. The hand puppet kit of claim 1 wherein said flexible material of said body member is a first, distinct color and said separate sheet of flexible material is second distinct and contrasting color.

5. The hand puppet kit of claim 1 including instructions for using said patterns for creating said pieces in said predetermined shapes and using said securing means to secure said pieces to said body member.

6. A hand puppet kit, comprising:

a sock-like body member formed of a flexible cloth material to have a hand receiving opening at one end thereof;

a separate sheet of flexible cloth material together with a plurality of patterns for creating a plurality of pieces in predetermined shapes, said predetermined shapes of said pieces including at least some head and body features, said separate sheet of flexible cloth material being larger in size than said patterns for creating pieces other than those in said predetermined shapes; and means for removably securing said pieces created from said separate sheet of flexible cloth material to said body member, said securing means including a hook fastener portion of a hook and loop fastener to be secured to said pieces with a pressure sensitive adhesive, said flexible cloth material of said body member being formed of a cloth having loop fastener portion characteristics;

said body member being a needle punched polypropylene fiber material texturized to produce a ribbed outer surface thereon, said needle punched polypropylene fiber material having been saturated with a water-based latex and dried in an oven to add stiffness and prevent material fuzzing.

7. The hand puppet kit of claim 6 wherein said flexible cloth material of said sock-like body member and said separate sheet of flexible cloth material are each formed of a different cloth material.

8. The hand puppet kit of claim 6 wherein said flexible material of said body member is a first, distinct color and said separate sheet of flexible material is a second, distinct and contrasting color.

9. The hand puppet kit of claim 6 wherein said flexible cloth material of said body member is a first color and including a plurality of sheets of flexible material of other contrasting colors.

10. The hand puppet kit of claim 6 including instructions for using said patterns for creating said pieces in said predetermined shapes and using said securing means to secure said pieces to said body member.

11. The hand puppet kit of claim 6 wherein said body member is formed of an arch-shaped piece of flexible cloth material doubled over, sewn along loose edges thereof, and inverted to conceal said sewn loose edges.

12. The hand puppet kit of claim 6 wherein said body member is formed by folding over a rectangular-shaped piece of fabric, sewing said fabric in an arched shape to provide excess material, trimming said excess material for use in creating additional pieces, and inverting said fabric to conceal sewn loose edges of said body portion.

* * * * *